US005908541A

United States Patent [19]

Castegnier

[11] Patent Number: 5,908,541

[45] Date of Patent: Jun. 1, 1999

[54] MULTICOLOR ELECTROCOAGULATION PRINTING METHOD AND APPARATUS

[75] Inventor: Adrien Castegnier, Outremont, Canada

[73] Assignee: Elcorsy Technology Inc., Saint-Laurent, Canada

[21] Appl. No.: 08/925,774

[22] Filed: Sep. 9, 1997

[51] Int. Cl.[6] ..... B41L 19/00

[52] U.S. Cl. ..... 204/486; 204/484; 204/603; 101/211; 101/DIG. 29; 101/DIG. 37

[58] Field of Search ..... 204/623, 486, 204/488, 484, 489, 492, 495, 508, 510; 101/489, 211, 49, DIG. 29, DIG. 37; 355/78, 104, 108

[56] References Cited

U.S. PATENT DOCUMENTS

| | | | |
|---|---|---|---|
| 4,661,222 | 4/1987 | Castegnier | 204/483 |
| 4,895,629 | 1/1990 | Castegnier | 204/483 |
| 5,084,716 | 1/1992 | Kaumura et al. | 101/489 |
| 5,142,306 | 8/1992 | Arahara et al. | 101/489 X |
| 5,449,392 | 9/1995 | Castegnier et al. | 118/46 |
| 5,538,601 | 7/1996 | Castegnier | 204/486 |
| 5,727,462 | 3/1998 | Castegnier | 101/211 |

FOREIGN PATENT DOCUMENTS

776768 A2 6/1997 European Pat. Off. .

*Primary Examiner*—T. Tung
*Assistant Examiner*—John S. Starsiak
*Attorney, Agent, or Firm*—Swabey Ogilvy Renault

[57] ABSTRACT

A polychromic image is reproduced and transferred onto a substrate by (a) providing a positive electrode moving at substantially constant speed along a predetermined path, the electrode having a passivated surface defining a positive electrode active surface; (b) forming on the positive electrode active surface a plurality of dots of colored, coagulated colloid representative of a desired image, by electrocoagulation of an electrolytically coagulable colloid present in an electrocoagulation printing ink containing a coloring agent; and (c) bringing an endless belt moving at the same speed as the positive electrode and having on one side thereof a colloid retaining surface adapted to releasably retain dots of electrocoagulated colloid, into contact with the positive electrode active surface to cause transfer of the dots of colored, coagulated colloid from the positive electrode active surface onto the colloid retaining surface of the belt and to thereby imprint same with the image. Steps (b) and (c) are repeated several times to define a corresponding number of printing stages arranged at predetermined locations along the path and each using a coloring agent of different color, thereby producing several differently colored images of coagulated colloid which are transferred at respective transfer positions onto the colloid retaining surface in superimposed relation to provide the desired polychromic image. A substrate is then brought into contact with the surface of the belt to cause transfer of the polychromic image from the colloid retaining surface onto the substrate and to thereby imprint the substrate with the polychromic image.

42 Claims, 3 Drawing Sheets

MULTICOLOR ELECTROCOAGULATION PRINTING METHOD AND APPARATUS

BACKGROUND OF THE INVENTION

The present invention pertains to improvements in the field of dynamic printing. More particularly, the invention relates to an improved multicolor electrocoagulation printing method and apparatus.

In U.S. Pat. No. 5,538,601 of Jul. 23, 1996, Applicant has described a multicolor electrocoagulation printing method and apparatus in which use is made of a single positive electrolytically inert electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is thereafter cleaned by means of a plurality of rotating brushes and a cleaning liquid to remove any residual coagulated colloid adhered to the surface of the positive electrode.

In order to provide a polychromic image, the negative electrodes, the positive electrode coating device, ink injector, rubber squeegee and positive electrode cleaning device are arranged to define a printing unit and several printing units each using a coloring agent of different color are disposed around the positive cylindrical electrode to produce several differently colored images of coagulated colloid which are transferred at respective transfer stations from the positive electrode active surface onto the substrate in superimposed relation to provide the desired polychromic image. The substrate which is in the form of a continuous web is partially wrapped around the positive electrode and passed through the respective transfer stations for being imprinted with the differently colored images in superimposed relation.

Since the paper web is brought into contact with the dots of colored, coagulated colloid produced by each printing unit, by the positive cylindrical electrode upon rotation thereof and pressed against the positive electrode active surface by pressure rollers for being imprinted with differently colored images of coagulated colloid, the web is often displaced between the positive electrode and the pressure rollers in a direction parallel to the longitudinal axis of the positive electrode. Accordingly, it is difficult to provide a polychromic image in which the differently colored images are perfectly superimposed.

SUMMARY OF THE INVENTION

It is therefore an object of the present invention to overcome the above drawback and to provide an improved multicolor electrocoagulation printing method and apparatus capable of providing a polychromic image of high definition.

According to one aspect of the invention, there is provided a multicolor electrocoagulation printing method comprising the steps of:

a) providing a positive electrolytically inert electrode having a continuous passivated surface moving at substantially constant speed along a predetermined path, the passivated surface defining a positive electrode active surface;

b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent;

c) bringing an endless non-extendable belt moving at substantially the same speed as the positive electrode and having on one side thereof a colloid retaining surface adapted to releasably retain dots of electrocoagulated colloid, into contact with the positive electrode active surface to cause transfer of the dots of colored, coagulated colloid from the positive electrode active surface onto the colloid retaining surface of the belt and to thereby imprint the colloid retaining surface with the image;

d) repeating steps (b) and (c) several times to define a corresponding number of printing stages arranged at predetermined locations along the aforesaid path and each using a coloring agent of different color, and to thereby produce several differently colored images of coagulated colloid which are transferred at respective transfer positions onto the colloid retaining surface in superimposed relation to provide a polychromic image; and e) bringing a substrate into contact with the colloid retaining surface of the belt to cause transfer of the polychromic image from the colloid retaining surface onto the substrate and to thereby imprint the substrate with said polychromic image.

The present invention also provides, in a further aspect thereof, an apparatus for carrying out a method as defined above. The apparatus of the invention comprises:

a single positive electrolytically inert electrode having a continuous passivated surface defining a positive electrode active surface;

means for moving the positive electrode active surface at a substantially constant speed along a predetermined path;

an endless non-extendable belt having on one side thereof a colloid retaining surface adapted to releasably retain dots of electrocoagulated colloid;

means for moving the belt at substantially the same speed as the positive electrode;

a plurality of printing units arranged at predetermined locations along the path, each printing unit comprising:

means for forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent, and means for bringing the belt into contact with the positive electrode active surface at a respective transfer station to cause transfer of the dots of colored, coagulated colloid from the positive electrode active surface onto the colloid retaining surface of the belt and to imprint the colloid retaining surface with the image, thereby producing several differently colored images of coagulated colloid which are transferred at the respective transfer stations onto the colloid retaining surface in superimposed relation to provide a polychromic image; and means for bringing a substrate into contact with the colloid retaining surface of the belt to cause transfer of the polychromic image from the colloid retaining surface onto the substrate and to thereby imprint the substrate with the polychromic image.

Applicant has found quite unexpectedly that by utilizing an endless non-extendable belt having a colloid retaining surface such as a porous surface on which dots of colored, coagulated colloid can be transferred and by moving such a belt independently of the positive electrode, from one printing unit to another, so that the colloid retaining surface of the belt contacts the colored, coagulated colloid in sequence, it is possible to significantly improve the registration of the differently colored images upon their transfer onto the colloid retaining surface of the belt, thereby providing a polychromic image of high definition which can thereafter be transferred onto the paper web or other substrate. For example, use can be made of a belt comprising a plastic material having a porous coating of silica.

The positive electrode used can be in the form of a moving endless belt as described in Applicant's U.S. Pat. No. 4,661,222, or in the form of a revolving cylinder as described in Applicant's U.S. Pat. No. 4,895,629 or in the aforementioned U.S. Pat. No. 5,538,601, the teachings of which are incorporated herein by reference. In later case, the printing units are arranged around the positive cylindrical electrode. Preferably, the positive electrode active surface and the ink are maintained at a temperature of about 35–60° C., preferably 40° C., to increase the viscosity of the coagulated colloid in step (b) so that the dots of colored, coagulated colloid remain coherent during their transfer in step (c), thereby enhancing transfer of the colored, coagulated colloid onto the substrate. For example, the positive electrode active surface can be heated at the desired temperature and the ink applied on the heated electrode surface to cause a transfer of heat therefrom to the ink.

When use is made of a positive electrode of cylindrical configuration rotating at substantially constant speed about its central longitudinal axis, step (b) of the above electrocoagulation printing method is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of the positive electrode and spaced from the positive electrode active surface by a constant predetermined gap, the negative electrodes being spaced from one another by a distance at least equal to the electrode gap;

ii) coating the positive electrode active surface with an olefinic substance and a metal oxide to form on the surface micro-droplets of olefinic substance containing the metal oxide;

iii) filling the electrode gap with the aforesaid electrocoagulation printing ink;

iv) electrically energizing selected ones of the negative electrodes to cause point-by-point selective coagulation and adherence of the colloid onto the olefin and metal oxide-coated positive electrode active surface opposite the electrode active surfaces of the energized negative electrodes while the positive electrode is rotating, thereby forming the dots of colored, coagulated colloid; and v) removing any remaining non-coagulated colloid from the positive electrode active surface.

As explained in U.S. Pat. No. 4,895,629, the teaching of which is incorporated herein by reference, spacing of the negative electrodes from one another by a distance which is equal to or greater than the electrode gap prevents the negative electrodes from undergoing edge corrosion. On the other hand, coating of the positive electrode with an olefinic substance and a metal oxide prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes.

Examples of suitable electrolytically inert metals from which the positive and negative electrodes can be made are stainless steel, platinum, chromium, nickel and aluminum. The positive electrode is preferably made of stainless steel, aluminum or tin so that upon electrical energization of the negative electrodes, dissolution of the passive oxide film on such an electrode generates trivalent ions which then initiate coagulation of the colloid.

The gap which is defined between the positive and negative electrodes can range from about 50 $\mu$ to about 100 $\mu$, the smaller the electrode gap the sharper are the dots of coagulated colloid produced. Where the electrode gap is of the order of 50 $\mu$, the negative electrodes are preferably spaced from one another by a distance of about 75 $\mu$.

Examples of suitable olefinic substances which may be used to coat the surface of the positive electrode in step (b) (ii) include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. The olefinic substance is advantageously applied onto the positive electrode active surface in the form of an oily dispersion containing the metal oxide as dispersed phase. Examples of suitable metal oxides include aluminum oxide, ceric oxide, chromium oxide, cupric oxide, magnesium oxide, manganese oxide, titanium dioxide and zinc oxide; chromium oxide is the preferred metal oxide. Depending on the type of metal oxide used, the amount of metal oxide may range from about 15 to about 40% by weight, based on the total weight of the dispersion. A particularly preferred dispersion contains about 75 wt. % of oleic acid or linoleic acid and about 25 wt. % of chromium oxide. Operating at a temperature of about 35–60° C. enables one to lower the concentration of metal oxide in the oily dispersion and thus to reduce wear of the positive electrode active surface.

The oily dispersion containing the olefinic substance and the metal oxide is advantageously applied onto the positive electrode active surface by providing a distribution roller extending parallel to the positive cylindrical electrode and having a peripheral coating comprising an oxide ceramic material, applying the oily dispersion onto the ceramic coating to form on a surface thereof a film of the oily dispersion uniformly covering the surface of the ceramic coating, the film of oily dispersion breaking down into micro-droplets containing the olefinic substance in admixture with the metal oxide and having substantially uniform size and distribution, and transferring the micro-droplets from the ceramic coating onto the positive electrode active surface. As explained in Applicant's U.S. Pat. No. 5,449,392 of Sep. 12, 1995, the teaching of which is incorporated herein by reference, the use of a distribution roller having a ceramic coating comprising an oxide ceramic material enables one to form on a surface of such a coating a film of the oily dispersion which uniformly covers the surface of the ceramic coating and thereafter breaks down into micro-droplets containing the olefinic substance in admixture with the metal oxide and having substantially uniform size and distribution. The micro-droplets formed on the surface of the ceramic coating and transferred onto the positive electrode active surface generally have a size ranging from about 1 to about 5 $\mu$.

A particularly preferred oxide ceramic material forming the aforesaid ceramic coating comprises a fused mixture alumina and titania. Such a mixture may comprise about 60 to about 90 weight % of alumina and about 10 to about 40 weight % of titania.

According to a preferred embodiment of the invention, the oily dispersion is applied onto the ceramic coating by disposing an applicator roller parallel to the distribution roller and in pressure contact engagement therewith to form a first nip, and rotating the applicator roller and the distribution roller in register while feeding the oily dispersion into the first nip, whereby the oily dispersion upon passing through the first nip forms a film uniformly covering the surface of the ceramic coating. The micro-droplets are advantageously transferred from the distribution roller to the positive electrode by disposing a transfer roller parallel to the distribution roller and in contact engagement therewith to form a second nip, positioning the transfer roller in pressure contact engagement with the positive electrode to form a third nip, and rotating the transfer roller and the positive electrode in register for transferring the micro-droplets from the distribution roller to the transfer roller at the second nip and thereafter transferring the micro-droplets from the transfer roller to the positive electrode at the third nip. Such an arrangement of rollers is described in the aforementioned U.S. Pat. No. 5,449,392.

Preferably, the applicator roller and the transfer roller are each provided with a peripheral covering of a resilient material which is resistant to attack by the olefinic substance, such as a synthetic rubber material. For example, use can be made of a polyurethane having a Shore A hardness of about 50 to about 70 in the case of the applicator roller, or a Shore A hardness of about 60 to about 80 in the case of the transfer roller.

The olefin and metal oxide-coated positive active surface is preferably polished to increase the adherence of the micro-droplets onto the positive electrode active surface, prior to step (b) (iii). For example, use can be made of a rotating brush provided with a plurality of radially extending bristles made of horsehair and having extremities contacting the surface of the positive electrode. The friction caused by the bristles contacting the surface upon rotation of the brush has been found to increase the adherence of the micro-droplets onto the positive electrode active surface.

Where the positive cylindrical electrode extends vertically, step (b) (iii) of the above electrocoagulation printing method is advantageously carried out by continuously discharging the ink onto the positive electrode active surface from a fluid discharge means disposed adjacent the electrode gap at a predetermined height relative to the positive electrode and allowing the ink to flow downwardly along the positive electrode active surface, the ink being thus carried by the positive electrode upon rotation thereof to the electrode gap to fill same. Preferably, excess ink flowing downwardly off the positive electrode active surface is collected and the collected ink is recirculated back to the fluid discharge means.

The colloid generally used is a linear colloid of high molecular weight, that is, one having a weight average molecular weight between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a weight average molecular weight of about 250,000 and sold by Cyanamid Inc. under the trade mark ACCOSTRENGTH 86. The colloid is preferably used in an amount of about 6.5 to about 12% by weight, and more preferably in an amount of about 7% by weight, based on the total weight of the colloidal dispersion. Water is preferably used as the medium for dispersing the colloid to provide the desired colloidal dispersion.

The ink also contains a soluble electrolyte and a coloring agent. Preferred electrolytes include alkali metal halides and alkaline earth metal halides, such as lithium chloride, sodium chloride, potassium chloride and calcium chloride. Potassium chloride is particularly preferred. When operating at a temperature of about 35–60° C., the electrolyte is preferably used in an amount of about 4.5 to about 10% by weight, based on the total weight of the dispersion. The coloring agent can be a dye or a pigment. Examples of suitable dyes which may be used to color the colloid are the water soluble dyes available from HOECHST such a Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the ink. Examples of suitable dispersing agents include the anionic dispersing agent sold by Boehme Filatex Canada Inc. under the trade mark CLOSPERSE 25000. The pigment is preferably used in an amount of about 6.5 to about 15% by weight, and the dispersing agent in an amount of about 0.1 to about 0.1% by weight, based on the total weight of the ink.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected ink, and the collected non-coagulated colloid in admixture with the collected ink is recirculated back to the aforesaid fluid discharge means.

The optical density of the dots of colored, coagulated colloid may be varied by varying the voltage and/or pulse duration of the pulse-modulated signals applied to the negative electrodes.

According to a preferred embodiment, step (c) is preferably carried out by providing at each transfer position a pressure roller extending parallel to the positive cylindrical electrode and pressed thereagainst to form a nip and permit the pressure roller to be driven by the positive electrode upon rotation thereof, and passing the belt through the nip. Preferably, the pressure roller is provided with a peripheral covering of a synthetic rubber material such as a polyurethane having a Shore A hardness of about 95. A polyurethane covering with such a hardness has been found to further improve transfer of the colored, coagulated colloid from the positive electrode active surface onto the porous surface of the belt. The pressure exerted between the positive electrode and the pressure roller preferably ranges from about 50 to about 100 $kg/cm^2$.

After step (c), the positive electrode active surface is generally cleaned to remove therefrom any remaining coagulated colloid. According to a preferred embodiment, the positive electrode is rotatable in a predetermined direction and any remaining coagulated colloid is removed from the positive electrode active surface by providing an elongated rotatable brush extending parallel to the longitudinal axis of the positive electrode, the brush being provided with a plurality of radially extending bristles made of horsehair and having extremities contacting the positive electrode active surface, rotating the brush in a direction opposite to the direction of rotation of the positive electrode so as to cause the bristles to frictionally engage the positive electrode active surface, and directing jets of cleaning liquid under pressure against the positive electrode active surface, from either side of the brush. In such an embodiment, the positive electrode active surface and the ink are preferably maintained at a temperature of about 35–60° C. by heating the cleaning liquid to thereby heat the positive electrode active surface upon contacting same and applying the ink on the heated electrode surface to cause a transfer of heat therefrom to the ink.

Preferably, the electrocoagulation printing ink contains water as the dispersing medium and the dots of differently colored, coagulated colloid representative of the polychromic image are moistened between steps (d) and (e) so that the polychromic image is substantially completely transferred onto the substrate in step (e).

According to another preferred embodiment, the substrate is in the form of a continuous web and step (e) is carried out by providing a support roller and a pressure roller extending parallel to the support roller and pressed thereagainst to form a nip through which the belt is passed, the support roller and pressure roller being driven by the belt upon movement thereof, and guiding the web so as to pass through the nip between the pressure roller and the colloid retaining surface of the belt for imprinting the web with the polychromic image. Preferably, the belt with the colloid retaining surface thereof imprinted with the polychromic image is guided so as to travel along a path extending in a plane intersecting the longitudinal axis of the positive electrode at right angles, thereby exposing the colloid retaining surface to permit contacting thereof by the web.

After step (e), the colloid retaining surface of the belt is generally cleaned to remove therefrom any remaining coagulated colloid. According to a preferred embodiment, any remaining coagulated colloid is removed from the colloid retaining surface of the belt by providing at least one elongated rotatable brush disposed on the one side of the belt and at least one support roller extending parallel to the brush and disposed on the opposite side of the belt, the brush and support roller having rotation axes disposed in a plane extending perpendicular to the belt, the brush being provided with a plurality of radially extending bristles made of horsehair and having extremities contacting the colloid retaining surface, rotating the brush in a direction opposite to the direction of movement of the belt so as to cause the bristles to frictionally engage the colloid retaining surface while supporting the belt with the support roller, directing jets of cleaning liquid under pressure against the colloid retaining surface from either side of the brush and removing the cleaning liquid with any dislodged coagulated colloid from the colloid retaining surface.

The invention enables one to significantly improve the registration of the differently colored images of coagulated colloid upon their transfer onto the colloid retaining surface of the belt, thereby providing a polychromic image of high definition which is thereafter transferred onto a paper web or other substrate.

BRIEF DESCRIPTION OF THE DRAWINGS

Further features and advantages of the invention will become more readily apparent from the following description of a preferred embodiment as illustrated by way of examples in the accompanying drawings, in which.

DESCRIPTION OF PREFERRED EMBODIMENTS

Figure 1:
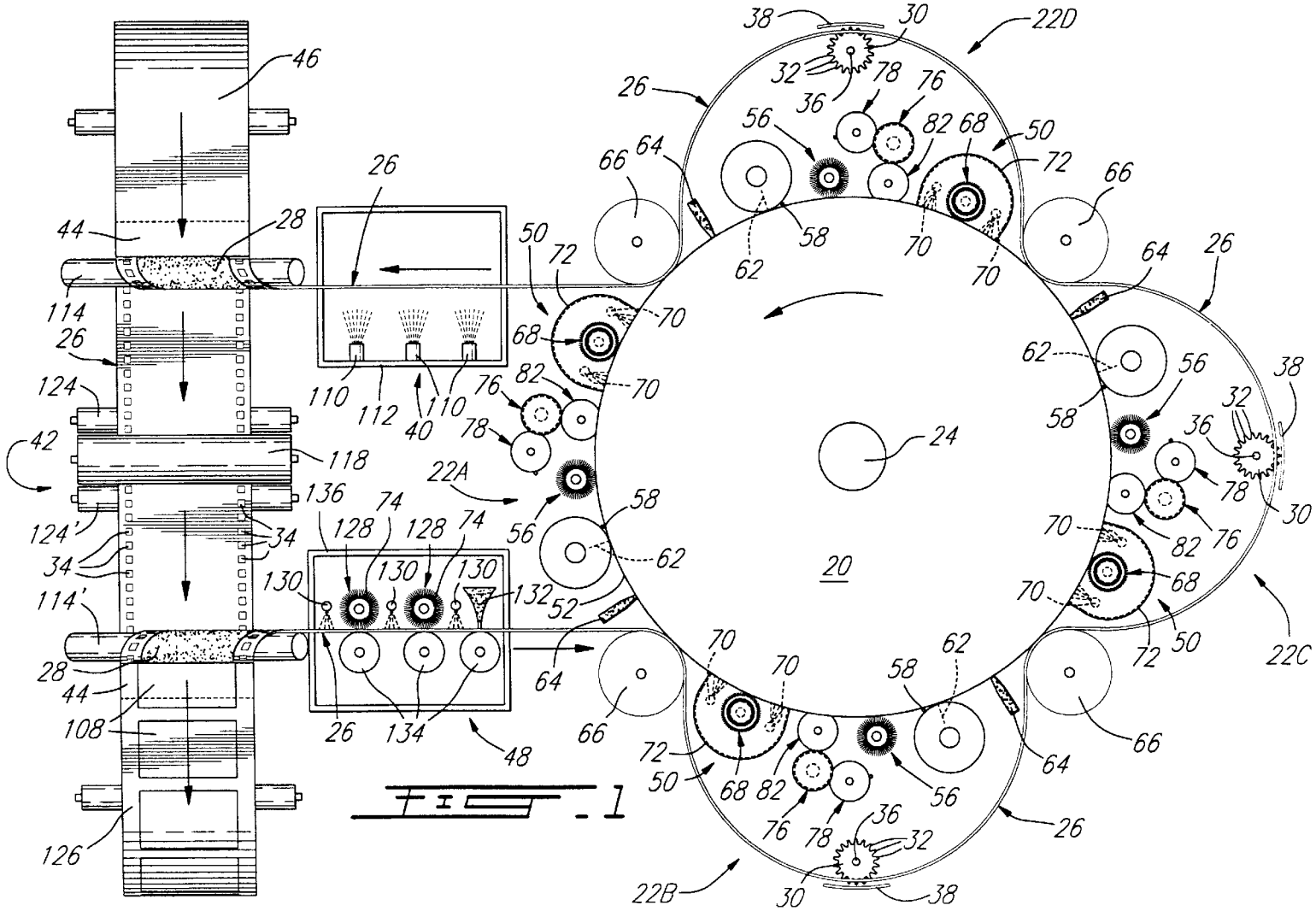
FIG. 1 is a schematic top plan view of a multicolor electrocoagulation printing apparatus according to a preferred embodiment of the invention.

Referring first to FIG. 1, there is illustrated a multicolor electrocoagulation printing apparatus comprising a central positive electrode 20 in the form of a revolving cylinder and four identical printing units 22 arranged around the cylindrical electrode 20. In the embodiment shown, the first printing unit 22A at the left of the figure is adapted to print in yellow color, the second printing unit 22B in magenta color, the third printing unit 22C in cyan color and the fourth printing unit 22D in black color. The cylindrical electrode 20 extends vertically and has a shaft 24 which is driven by a motor (not shown) for rotating the electrode about a vertical axis coincident with the shaft 24. An endless non-extendable belt 26 having a porous surface 28 (best shown in FIG. 4) on one side thereof is displaced to the printing units for imprinting the porous surface 28 with differently colored images which are transferred at respective transfer stations onto the surface 28 in superimposed relation to provide a polychromic image. The belt 26 is driven at the same speed as the electrode 20 by means of three pairs of sprockets 30 (only three sprockets shown) having teeth 32 engaging two series of longitudinally spaced perforations 34 formed in the belt 26 adjacent the edges thereof, the sprockets 30 of each pair being keyed to a respective shaft 36 which is mechanically to the shaft 24 of the electrode 20. The belt 26 is retained in engagement with the sprockets 30 by arcuate guide members 38. The apparatus further includes a moistening device 40 for moistening any dried dots of colored, coagulated colloid on the surface 28 of the belt 26 and representative of the polychromic image, a transfer device for transferring the polychromic image from the surface 28 of the belt 26 onto a paper web 44 fed from a feed roller 46 and a cleaning device 48 for cleaning the surface 28 of the belt 26.

Figure 2:
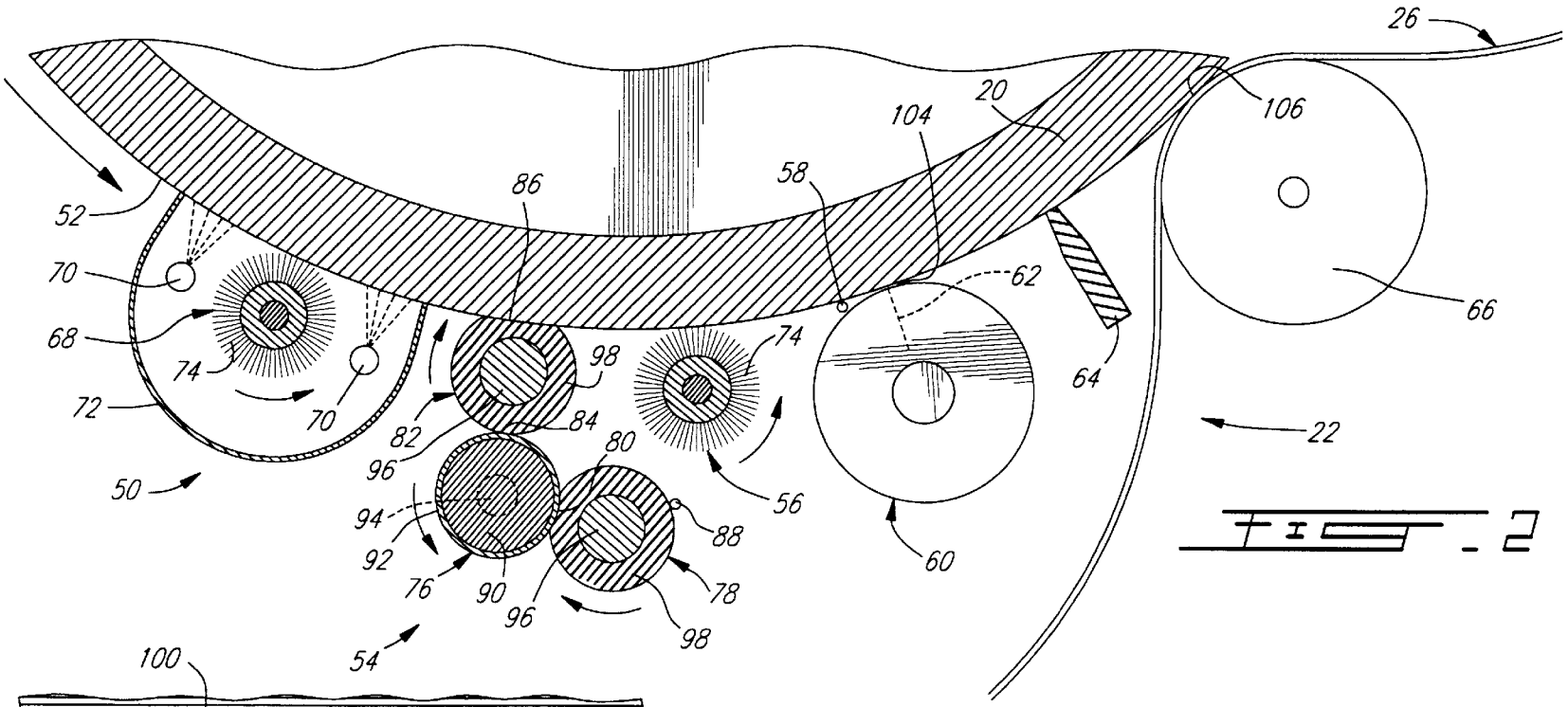
FIG. 2 is a fragmentary sectional view thereof, showing one of the printing units.
Figure 3:
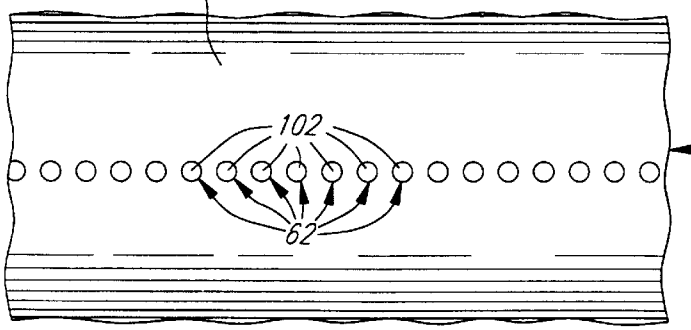
FIG. 3 is a fragmentary longitudinal view of one of the printing heads used for electrocoagulation of the colloid.

As best shown in FIG. 2, the printing units 22 each comprise a cleaning device 50 for cleaning the surface 52 of the positive electrode 20, a positive electrode coating device 54 for coating the surface 52 with an olefinic substance and a metal oxide, a polishing brush 56 for polishing the olefin and metal oxide-coated surface 52, a device 58 for discharging an electrocoagulation printing ink onto the surface 52, a printing head 60 provided with negative electrodes 62 for electrocoagulating the colloid contained in the ink to form on the positive electrode surface 52 dots of colored, coagulated colloid representative of a desired image and a soft rubber squeegee 64 for removing any remaining non-coagulated colloid from the surface 52. Each printing unit 22 further includes a pressure roller 66 for bringing the belt 26 into contact with the positive electrode surface 52 to cause transfer of the dots of colored, coagulated colloid from the surface 52 onto the porous surface 28 of the belt 26 and to thereby imprint the web with the image. As shown in FIG. 1, the provision of two pairs of diametrically opposed pressure rollers 66 arranged about the cylindrical electrode 20 prevents the electrode 20 from flexing since the forces exerted by the rollers 66 of each pair cancel each other out.

The positive electrode cleaning devices 50 each comprise a rotating brush 68 and two high pressure water injectors 70 arranged in a housing 72. Each brush 68 rotates in a counterclockwise manner and is provided with a plurality of radially extending bristles 74 which are made of horsehair and have extremities contacting the surface 52. Any coagulated colloid remaining on the surface 52 after transfer of the dots of colored, coagulated colloid at the transfer station of a preceding printing unit is thus removed by the brush 68 and washed away by the powerful jets of water produced by the injectors 70.

The positive electrode coating devices 54 each comprise a vertically extending distribution roller 76, an applicator roller 78 extending parallel to the distribution roller 76 and in pressure contact engagement therewith to form a nip 80, and a transfer roller 82 extending parallel to the roller 76 and in contact engagement therewith to form a nip 84. The transfer roller 82 is in pressure contact engagement with the positive electrode 20 to form a nip 86 and permit the roller 82 to be driven by the positive electrode 20 upon rotation thereof. Each coating device 54 further includes a feeding device 88 for supplying to the applicator roller 78 the olefinic substance in the form of an oily dispersion containing the metal oxide as dispersed phase.

The distribution roller 76 has a solid core 90 of metal provided with a peripheral coating 92 of oxide ceramic material. A pair of stub shafts 94 (only one shown) integral with the core 90 extends outwardly from the extremities of the roller 76. The applicator roller 78 and transfer roller 82 also have a solid core 96 of metal, but are provided with a peripheral covering 98 of polyurethane. The rollers 76 and 78 are rotated in register by means of a motor (not shown) driving the shaft 94 of the distribution roller 76. The drive from the motor rotates the distribution roller 76 in a counterclockwise manner, which in turn transmits a clockwise rotation to the applicator roller 78.

The feeding device 88 is adapted to discharge the oily dispersion onto the applicator roller 78 at an upper portion thereof. The dispersion then flows downwardly under gravity along the roller 78 and is carried to the nip 80 by the roller 78 during rotation thereof. The dispersion upon passing through the nip 80 forms a film uniformly covering the surface of the ceramic coating 90 of the distribution roller 76, the film breaking down into micro-droplets containing the olefinic substance in admixture with the metal oxide and having substantially uniform size and distribution. The micro-droplets formed on the roller 76 are carried by the latter to the nip 84 where they are transferred onto the transfer roller 82. The micro-droplets are then carried by the roller 82 to the nip 86 where they are transferred onto the positive electrode 20.

The polishing brushes 56 used for polishing the olefin and metal oxide-coated surface 52 of the positive electrode 20 are similar to the brushes 68, each brush 56 rotating in a counterclockwise manner and being provided with a plurality of radially extending bristles 74 made of horsehair and having extremities contacting the surface 52. The friction caused by the bristles 74 contacting the surface 52 upon rotation of the brush 56 has been found to increase the adherence of the micro-droplets of olefinic substance containing the metal oxide onto the positive electrode surface 52.

As shown in FIG. 5, each printing head 60 comprises a cylindrical body 100 with the negative electrodes 62 being electrically insulated from one another and arranged in rectilinear alignment along the length of the body 100 to define a series of corresponding negative electrode active surfaces 102. The printing head 60 is positioned relative to the positive electrode 20 such that the surfaces 102 of the negative electrodes 62 are disposed in a plane parallel to the central longitudinal axis of the electrode 20 and are spaced from the positive electrode surface 52 by a constant predetermined gap 104. The electrodes 62 are also spaced from one another by a distance at least equal to the electrode gap 104 to prevent edge corrosion of the negative electrodes.

The device 58 which is used to fill the electrode gap 104 with an electrocoagulation printing ink consisting of a colloidal dispersion containing an electrolytically coagulable colloid, a dispersing medium, a soluble electrolyte and a coloring agent is disposed adjacent the electrode gap 104 and is adapted to discharge the ink onto the positive electrode surface 52 at a predetermined height relative to the positive electrode 20. As the ink is being discharged from the device 58 onto the positive electrode surface 52, it flows downwardly along the surface 52 and is carried by the positive electrode 20 upon rotation thereof to the electrode gap 104 to fill same.

Electrical energizing of selected ones of the negative electrodes 62 causes point-by-point selective coagulation and adherence of the colloid onto the olefin and metal oxide-coated surface 52 of the positive electrode 20 opposite the electrode active surfaces 102 of the energized negative electrodes 62 while the electrode 20 is rotating, thereby forming a series of corresponding dots of colored, coagulated colloid representative of a desired image. After electrocoagulation of the colloid, any remaining non-coagulated colloid is removed from the positive electrode surface 52 by the squeegee 64 so as to fully uncover the dots of colored, coagulated colloid adhered on the surface 52.

The optical density of the dots of colored, coagulated colloid may be varied by varying the voltage and/or pulse duration of the pulse-modulated signals applied to the negative electrodes 62. Synchronisation of the data furnished to the printing heads 60 is ensured by proper electronic circuitry (not shown).

The pressure rollers 66 which serve to bring the belt 26 into contact with the positive electrode active surface 52 at the respective transfer stations are each urged against the positive electrode 20 to form a nip 106 through which the belt 26 is passed and permit the rollers 66 to be driven by the positive electrode 20 upon rotation thereof. As the surface 28 of the belt 26 is contacted with the dots of colored, coagulated colloid on the surface 52, the colored, coagulated colloid is transferred from the surface 52 onto the surface 28 to thereby imprint same with the image. The differently colored images produced by the printing units 22A, 22B, 22C and 22D are thus transferred onto the surface 28 of the belt 26 in superimposed relation to provide a polychromic image 108 (shown in FIG. 4).

The polychromic images 108 are then conveyed by the belt 26 to the moistening device 40 which comprises a plurality of spray nozzles 110 arranged in a housing 112. An aqueous solution containing a surfactant is sprayed by the nozzles 110 onto the surface 28 of the belt 26 in order to moisten any dried dots of colored, coagulated colloid representative of the images 108, thereby ensuring that the polychromic images 108 are substantially completely transferred from the surface 28 onto the paper web 44 by the transfer device 42.

Figure 4:
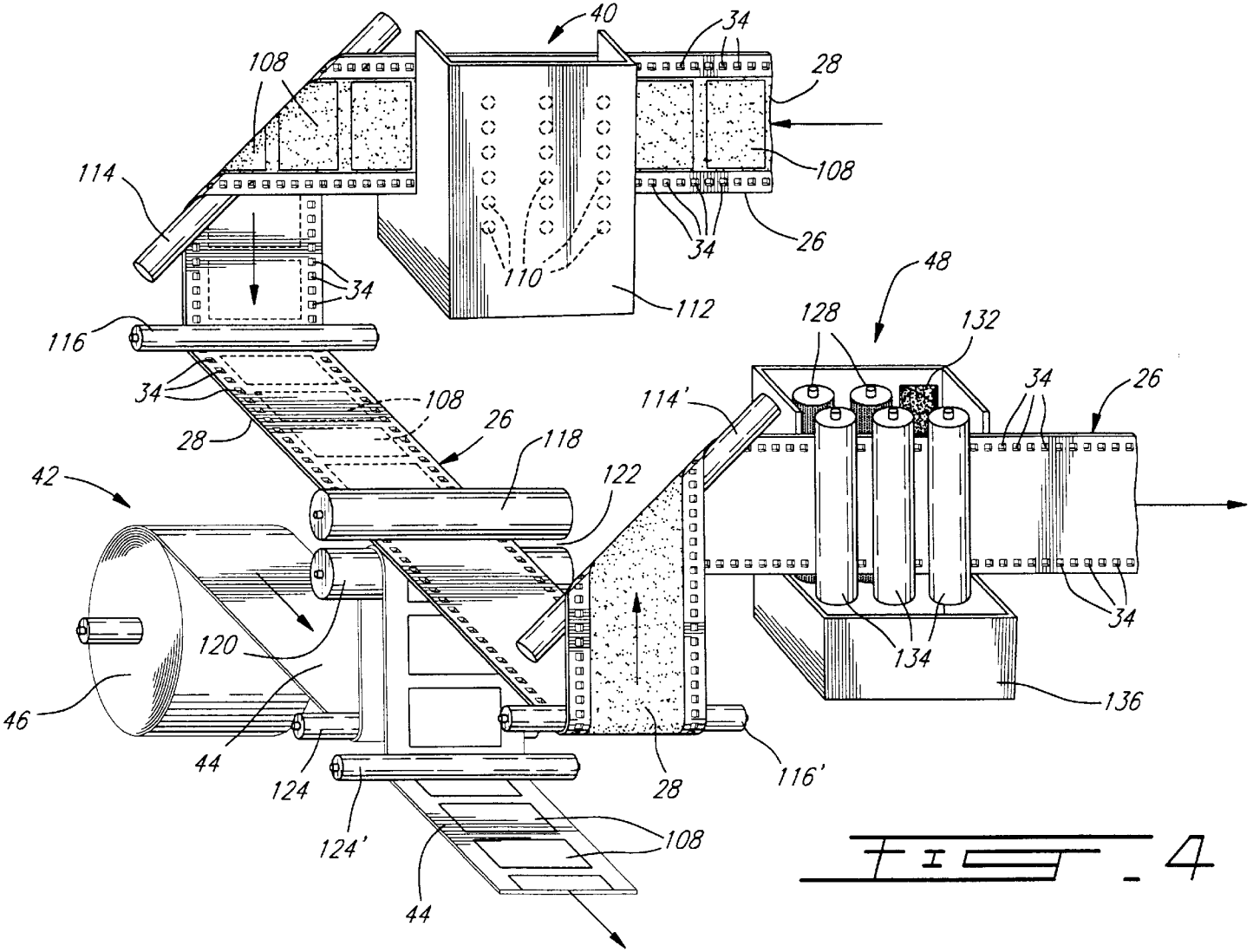
FIG. 4 is a fragmentary schematic perspective view of the apparatus illustrated in FIG. 1, showing the image wetting device, image transfer device and belt cleaning device.

As shown in FIG. 4, the transfer device 42 comprises a pair of inclined turn bars 114,114' and a pair of guide rollers 116,116' disposed relative to one another for guiding the belt 26 so that it travels along a horizontal path with the surface 28 facing downwardly, thereby exposing the surface 28 to permit contacting thereof by the paper web 44. The device further includes a support roller 118 and a pressure roller 120 extending parallel to the roller 118 and pressed thereagainst to form a nip 122 through which the belt 26 is passed and to permit the rollers 118,120 to be driven by the belt 26 upon movement thereof. The rotation axes of the support roller 118 and pressure roller 120 are disposed in a plane which extends perpendicular to the horizontal path along which the belt 26 travels. The paper web 44 is guided by a pair of guide rollers 124,124' so as to pass through the nip 122 between the pressure roller 120 and the surface 28 of the belt 26, for being imprinted with the polychromic images 108 which are transferred from the surface 28 onto the web 44. The paper web 44 imprinted with the images 108 is then taken up by a collect roller 126.

After the polychromic images 108 have been transferred from the surface 28 of the belt 26 onto the paper web 44, the belt 26 is sent to the cleaning device 48 for removing any remaining coagulated colloid from the surface 28. The cleaning device 48 comprises two rotating brushes 128, three high pressure water injectors 130 (shown in FIG. 1) and a rubber squeegee 132 disposed on one side of the belt 26, as well as three support rollers 134 disposed on the other side of the belt, all being arranged in a housing 136. Each brush 128 rotates in a clockwise manner and is provided with a plurality of radially extending bristles 74 which are made of horsehair and have extremities contacting the surface 28 of the belt 26. Any coagulated colloid remaining on the surface 28 is thus removed by the brushes 128 and washed away by the powerful jets of water produced by the injectors 130.

I claim:

1. A multicolor electrocoagulation printing method comprising the steps of:

a) providing a positive electrolytically inert electrode having a continuous passivated surface moving at substantially constant speed along a predetermined path, said passivated surface defining a positive electrode active surface;

b) forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent;

c) bringing an endless non-extendable belt moving at substantially the same speed as said positive electrode and having on one side thereof a colloid retaining surface adapted to releasably retain dots of electrocoagulation colloid, into contact with said positive electrode active surface to cause transfer of the dots of colored, coagulated colloid from the positive electrode active surface onto the colloid retaining surface of said belt and to thereby imprint said colloid retaining surface with the image;

d) repeating steps (b) and (c) several times to define a corresponding number of printing stages arranged at predetermined locations along said path and each using a coloring agent of different color, and to thereby produce several differently colored images of coagulated colloid which are transferred at respective transfer positions onto said colloid retaining surface in superimposed relation to provide a polychromic image; and e) bringing a substrate into contact with the colloid retaining surface of said belt to cause transfer of the polychromic image from said colloid retaining surface onto said substrate and to thereby imprint said substrate with said polychromic image.

2. A method as claimed in claim 1, wherein said positive electrode is a cylindrical electrode having a central longitudinal axis and rotating at substantially constant speed about said longitudinal axis, and wherein said printing stages are arranged around said positive cylindrical electrode.

3. A method as claimed in claim 2, wherein step (b) is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant predetermined gap, said negative electrodes being spaced from one another by a distance at least equal to said electrode gap;

ii) coating the positive electrode active surface with an olefinic substance and a metal oxide to form on said surface micro-droplets of olefinic substance containing the metal oxide;

iii) filling said electrode gap with said electrocoagulation printing ink;

iv) electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, thereby forming said dots of colored, coagulated colloid; and v) removing any remaining non-coagulated colloid from said positive electrode active surface.

4. A method as claimed in claim 3, wherein step (b) (ii) is carried out by providing a distribution roller extending parallel to said positive electrode and having a peripheral coating comprising an oxide ceramic material, applying said olefinic substance in the form of an oily dispersion containing said metal oxide as dispersed phase onto the ceramic coating to form on a surface thereof a film of said oily dispersion uniformly covering the surface of said ceramic coating, said film of oily dispersion breaking down into micro-droplets containing said olefinic substance in admixture with said metal oxide and having substantially uniform size and distribution, and transferring said micro-droplets from said ceramic coating onto said positive electrode active surface.

5. A method as claimed in claim 4, wherein said oxide ceramic material comprises a fused mixture of alumina and titania.

6. A method as claimed in claim 4, wherein said oily dispersion is applied onto said ceramic coating by disposing an applicator roller parallel to said distribution roller and in pressure contact engagement therewith to form a first nip, and rotating said applicator roller and said distribution roller in register while feeding said oily dispersion into said first nip, whereby said oily dispersion upon passing through said first nip forms said film uniformly covering the surface of said ceramic coating.

7. A method as claimed in claim 6, wherein said micro-droplets are transferred from said distribution roller to said positive electrode by disposing a transfer roller parallel to said distribution roller and in contact engagement therewith to form a second nip, positioning said transfer roller in pressure contact engagement with said positive electrode to form a third nip, and rotating said transfer roller and said positive electrode in register for transferring said micro-droplets from said distribution roller to said transfer roller at said second nip and thereafter transferring said micro-droplets from said transfer roller to said positive electrode at said third nip.

8. A method as claimed in claim 7, wherein said applicator roller and said transfer roller are each provided with a peripheral covering of a resilient material which is resistant to attack by said olefinic substance.

9. A method as claimed in claim 2, wherein step (c) is carried out by providing at each transfer position a pressure roller extending parallel to said positive electrode and pressed thereagainst to form a nip and permit said pressure roller to be driven by said positive electrode upon rotation thereof, and passing said belt through said nip.

10. A method as claimed in claim 9, wherein there are at least two printing stages each including one said pressure roller and wherein said pressure rollers are arranged in pairs with the pressure rollers of each pair being diametrically opposed to one another.

11. A method as claimed in claim 2, further including the step of removing after step (c) of each printing stage any remaining coagulated colloid from said positive electrode active surface.

12. A method as claimed in claim 11, wherein said positive electrode is rotatable in a predetermined direction and wherein any remaining coagulated colloid is removed from said positive electrode active surface by providing an elongated rotatable brush extending parallel to the longitudinal axis of said positive electrode, said brush being provided with a plurality of radially extending bristles having extremities contacting said positive electrode active surface, rotating said brush in a direction opposite to the direction of rotation of said positive electrode so as to cause said bristles to frictionally engage said positive electrode active surface, and directing jets of cleaning liquid under pressure against said positive electrode active surface, from either side of said brush.

13. A method as claimed in claim 1, wherein said dispersing medium is water and wherein the dots of differently colored, coagulated colloid representative of said polychromic image are moistened between steps (d) and (e) so that said polychromic image is substantially completely transferred onto said substrate in step (e).

14. A method as claimed in claim 2, wherein said substrate is in the form of a continuous web and wherein step (e) is carried out by providing a support roller and a pressure roller extending parallel to said support roller and pressed thereagainst to form a nip through which said belt is passed, said support roller and pressure roller being driven by said belt upon movement thereof, and guiding said web so as to pass through said nip between said pressure roller and the porous surface of said belt for imprinting said web with said polychromic image.

15. A method as claimed in claim 14, further including the step of guiding said belt with the porous surface thereof imprinted with said polychromic image so that said belt travels along a path extending in a plane intersecting the longitudinal axis of said positive electrode at right angles, thereby exposing said porous surface to permit contacting thereof by said web.

16. A method as claimed in claim 15, wherein the longitudinal axis of said positive electrode extends vertically and wherein said belt is guided so as to travel along a horizontal path with said porous surface facing downwardly, said support roller and pressure roller having rotation axes disposed in a plane extending perpendicular to said horizontal path.

17. A method as claimed in claim 1, further including the step of removing after step (e) any remaining coagulated colloid from the porous surface of said belt.

18. A method as claimed in claim 17, wherein any remaining coagulated colloid is removed from said porous surface by providing at least one elongated rotatable brush disposed on said one side of said belt and at least one support roller extending parallel to said brush and disposed on the opposite side of said belt, said brush and support roller having rotation axes disposed in a plane extending perpendicular to said belt, said brush being provided with a plurality of radially extending bristles having extremities contacting said porous surface, rotating said brush in a direction opposite to the direction of movement of said belt so as to cause said bristles to frictionally engage said porous surface while supporting said belt with said support roller, directing jets of cleaning liquid under pressure against said porous surface from either side of said brush and removing said cleaning liquid with any dislodged coagulated colloid from said porous surface.

19. A method as claimed in claim 1, wherein said colloid retaining surface is a porous surface.

20. A method as claimed in claim 19, wherein said belt is made of plastic material having a porous coating of silica thereon.

21. A multicolor electrocoagulation printing apparatus comprising:

a positive electrolytically inert electrode having a continuous passivated surface defining a positive electrode active surface;

means for moving said positive electrode active surface at a substantially constant speed along a predetermined path;

an endless non-extendable belt having on one side thereof a colloid retaining surface adapted to releasably retain dots of electrocoagulated colloid;

means for moving said belt at substantially the same speed as said positive electrode;

a plurality of printing units arranged at predetermined locations along said path, each printing unit comprising:

means for forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent, and means for bringing said belt into contact with said positive electrode active surface at a respective transfer station to cause transfer of the dots of colored, coagulated colloid from the positive electrode active surface onto the colloid retaining surface of said belt and to imprint said colloid retaining surface with the image, thereby producing several differently colored images of coagulated colloid which are transferred at said respective transfer stations onto said colloid retaining surface in superimposed relation to provide a polychromic image; and means for bringing a substrate into contact with the colloid retaining surface of said belt to cause transfer of the polychromic image from said colloid retaining surface onto said substrate and to thereby imprint said substrate with said polychromic image.

22. An apparatus as claimed in claim 21, wherein said positive electrode is a cylindrical electrode having a central longitudinal axis and wherein said means for moving said positive electrode active surface includes means for rotating said positive cylindrical electrode about said longitudinal axis, said printing units being arranged around said positive cylindrical electrode.

23. An apparatus as claimed in claim 22, wherein said means for forming said dots of colored, coagulated colloid comprises:

a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant predetermined gap, said negative electrodes being spaced from one another by a distance at least equal to said electrode gap;

means for coating the positive electrode active surface with an olefinic substance and a metal oxide to form on said surface micro-droplets of olefinic substance containing the metal oxide;

means for filling said electrode gap with said electrocoagulation printing ink;

means for electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, thereby forming said dots of colored, coagulated colloid; and means for removing any remaining noncoagulated colloid from said positive electrode active surface.

24. An apparatus as claimed in claim 23, wherein said means for coating said positive electrode active surface comprises a distribution roller extending in spaced-apart parallel relation to said positive electrode, said distribution roller having a peripheral coating comprising an oxide ceramic material, applicator means for applying said olefinic substance in the form of an oily dispersion containing said metal oxide as dispersed phase onto the ceramic coating to form on a surface thereof a film of said oily dispersion uniformly covering the surface of said ceramic coating, said film of oily dispersion breaking down into micro-droplets containing said olefinic substance in admixture with said metal oxide and having substantially uniform size and distribution, and transfer means arranged between said distribution roller and said positive electrode for transferring said micro-droplets from said ceramic coating onto said positive electrode active surface.

25. An apparatus as claimed in claim 24, wherein said oxide ceramic material comprises a fused mixture of alumina and titania.

26. An apparatus as claimed in claim 24, wherein said applicator means comprise an applicator roller extending parallel to said distribution roller and in pressure contact engagement therewith to form a first nip, means rotating said applicator roller and said distribution roller in register and feed means for feeding said oily dispersion into said first nip, whereby said oily dispersion upon passing through said first nip forms said film uniformly covering the surface of said ceramic coating.

27. An apparatus as claimed in claim 26, wherein said transfer means comprises a transfer roller extending parallel to said distribution roller and in contact engagement therewith to form a second nip, said transfer roller being in pressure contact engagement with said positive electrode to form a third nip and permit said transfer roller to be driven by said positive electrode upon rotation thereof, whereby said micro-droplets are transferred from said distribution roller to said transfer roller at said second nip and thereafter from said transfer roller to said positive electrode at said third nip.

28. An apparatus as claimed in claim 27, wherein said applicator roller and said transfer roller are each provided with a peripheral covering of a resilient material which is resistant to attack by said olefinic substance.

29. An apparatus as claimed in claim 23, wherein each said printing unit further includes means for polishing the olefin and metal oxide-coated positive electrode active surface to increase adherence of said micro-droplets onto said positive electrode active surface, prior to filling said electrode gap with said electrocoagulation printing ink.

30. An apparatus as claimed in claim 22, wherein said means for bringing said belt into contact with said positive electrode active surface at said respective transfer station comprises a pressure roller extending parallel to said positive electrode and pressed thereagainst to form a nip through which said belt is passed and to permit said pressure roller to be driven by said positive electrode upon rotation thereof.

31. An apparatus as claimed in claim 30, wherein there are at least two printing units each including one said pressure roller and wherein said pressure rollers are arranged in pairs with the pressure rollers of each pair being diametrically opposed to one another.

32. An apparatus as claimed in claim 22, wherein each said printing unit further includes means for removing any remaining coagulated colloid from said positive electrode active surface after transfer of said dots of colored, coagulated colloid onto the porous surface of said belt.

33. An apparatus as claimed in claim 32, wherein said positive electrode is rotatable in a predetermined direction and wherein said means for removing any remaining coagulated colloid removed from said positive electrode active surface comprise an elongated rotatable brush extending parallel to the longitudinal axis of said positive electrode, said brush being provided with a plurality of radially extending bristles having extremities contacting said positive electrode active surface, means for rotating said brush in a direction opposite to the direction of rotation of said positive electrode so as to cause said bristles to frictionally engage said positive electrode active surface, and means for directing jets of cleaning liquid under pressure against said positive electrode active surface, from either side of said brush.

34. An apparatus as claimed in claim 21, wherein said dispersing medium is water and wherein said apparatus further includes means for moistening the dots of differently colored, coagulated colloid representative of said polychromic image after transfer onto the porous surface of said belt so as to permit said polychromic image to be substantially completely transferred onto said substrate.

35. An apparatus as claimed in claim 22, wherein said substrate is in the form of a continuous web and wherein said means for bringing the web into contact with the porous surface of said belt comprises a support roller and a pressure roller extending parallel to said support roller and pressed thereagainst to form a nip through which said belt is passed and to permit said support roller and pressure roller to be driven by said belt upon movement thereof, and web guide means for guiding said web so as to pass through said nip between said pressure roller and the porous surface of said belt for imprinting said web with said polychromic image.

36. An apparatus as claimed in claim 35, further including belt guide means for guiding said belt with the porous surface thereof imprinted with said polychromic image so that said belt travels along a path extending in a plane intersecting the longitudinal axis of said positive electrode at right angles, thereby exposing said porous surface to permit contacting thereof by said web.

37. An apparatus as claimed in claim 36, wherein the longitudinal axis of said positive electrode extends vertically and wherein said belt guide means comprise a pair of inclined turn bars and a pair of guide rollers disposed relative to one another so that said belt travels along a horizontal path with said porous surface facing downwardly, said support roller and pressure roller having rotation axes disposed in a plane extending perpendicular to said horizontal path.

38. An apparatus as claimed in claim 21, further including means for removing any remaining coagulated colloid from the porous surface of said belt after transfer of said polychromic image onto said substrate.

39. An apparatus as claimed in claim 38, wherein said means for removing any remaining coagulated colloid from said porous surface comprise at least one elongated rotatable brush disposed on said one side of said belt and at least one support roller extending parallel to said brush and disposed on the opposite side of said belt, said brush and support roller having rotation axes disposed in a plane extending perpendicular to said belt, said brush being provided with a plurality of radially extending bristles having extremities contacting said porous surface, means for rotating said brush in a direction opposite to the direction of movement of said belt so as to cause said bristles to frictionally engage said porous surface while being supported by said support roller, means for directing jets of cleaning liquid under pressure against said porous surface from either side of said brush and means for removing said cleaning liquid with any dislodged coagulated colloid from said porous surface.

40. An apparatus as claimed in claim 21, wherein said positive electrode is made of stainless steel or aluminum.

41. An apparatus as claimed in claim 21, wherein said colloid retaining surface is a porous surface.

42. An apparatus as claimed in claim 41, wherein said belt is made of plastic material having a porous coating of silica thereon.

* * * * *